US005913365A

United States Patent [19]

Bryant

[11] Patent Number: 5,913,365

[45] Date of Patent: Jun. 22, 1999

[54] METHOD FOR REMOVING A GRAVEL PACK SCREEN

[75] Inventor: David Wade Bryant, Abita Springs, La.

[73] Assignee: Mobil Oil Corporation, Fairfax, Va.

[21] Appl. No.: 08/838,387

[22] Filed: Apr. 8, 1997

[51] Int. Cl.[6] ..... E21B 37/08

[52] U.S. Cl. ..... 166/311; 166/222; 166/312; 166/387

[58] Field of Search ..... 166/158, 191, 166/222, 223, 278, 311, 312, 381, 387

[56] References Cited

U.S. PATENT DOCUMENTS

| | | | |
|---|---|---|---|
| 1,379,815 | 5/1921 | Hall | 166/222 X |
| 2,120,988 | 6/1938 | Park | 166/222 |
| 2,149,417 | 3/1939 | Brown | 166/301 |
| 2,186,309 | 1/1940 | Travis | 166/223 X |
| 2,213,987 | 9/1940 | Layne | 166/278 |
| 2,290,141 | 7/1942 | Burt . | |
| 2,356,769 | 8/1944 | Layne | 166/312 |
| 2,677,428 | 5/1954 | Clark | 166/312 X |
| 4,037,661 | 7/1977 | Ford | 166/311 |
| 4,040,486 | 8/1977 | Kirkland, Jr. | 166/311 |
| 4,671,359 | 6/1987 | Renfro | 166/312 |
| 4,694,901 | 9/1987 | Skinner | 166/312 X |
| 4,763,728 | 8/1988 | Lacey | 166/191 |
| 4,856,590 | 8/1989 | Caillier | 166/278 |
| 4,909,325 | 3/1990 | Hopmann | 166/312 |
| 5,533,571 | 7/1996 | Surjaatmadja | 166/222 |
| 5,603,378 | 2/1997 | Alford | 166/222 |

*Primary Examiner*—George Suchfield
*Attorney, Agent, or Firm*—Malcolm D. Keen

[57] ABSTRACT

A method for removing a gravel-pack screen from a wellbore. of a well which has been "gravel packed". When it is desired to remove the screen from the wellbore, a washstring is lowered down the wellbore and into the interior of said screen. A wash fluid is then flowed fluid down the washstring and out through said screen into said mass of gravel surrounding the screen to fluidize, loosen, and remove said gravel. Once the mass of gravel has been loosen, the screen can then lifted upward out of said wellbore by applying a normal upward force the workstring which suspends the screen within the well.

12 Claims, 1 Drawing Sheet

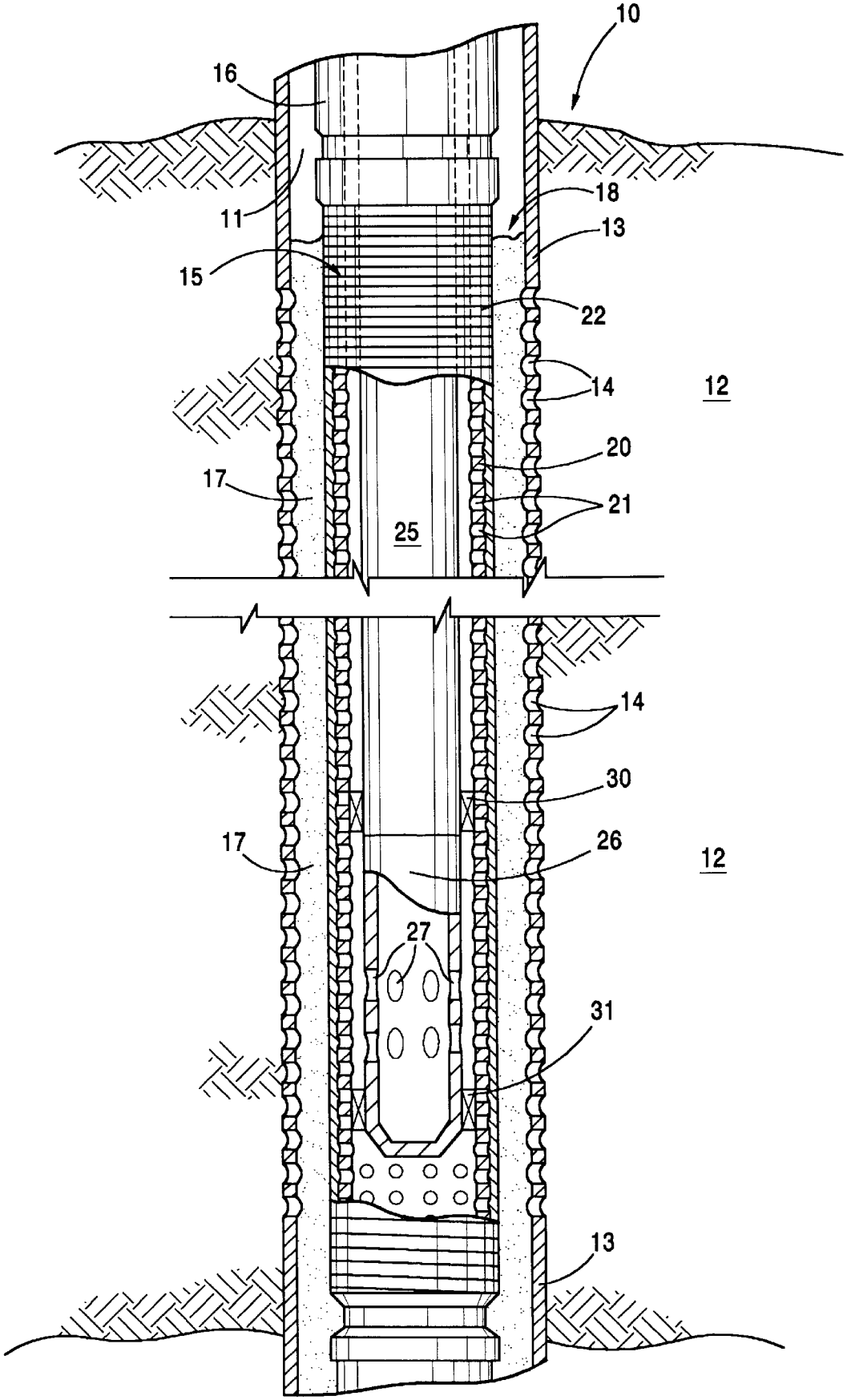
10
16
11
18
13
15
22
14
12
20
17
21
25
14
30
17
26
12
27
31
13

METHOD FOR REMOVING A GRAVEL PACK SCREEN

DESCRIPTION

1. Technical Field

The present invention relates to a method for "unloading a gravel-pack screen" so the screen can be removed from a wellbore and in one of its aspects relates to a method for removing a gravel-packed well screen from a wellbore by flowing fluid through a wash tool which is lowered inside said screen to agitate and remove the pack of gravel surrounding said screen so that the screen can be pulled to the surface.

2. Background of the Invention

In producing hydrocarbons or the like from loosely or unconsolidated and/or fractured subterranean formations, it is not uncommon to produce large volumes of particulate material (e.g. sand) along with the formation fluids. These particulates, if not controlled, can cause a variety of problems which seriously affect the production from the well.

Probably, the most popular technique used for controlling the production of particulates and the like from a formation is one which is known as "gravel packing". In a typical gravel pack completion, a "screen" is lowered on a workstring (e.g. production tubing) into the wellbore and is positioned adjacent the producing formation. Particulate material, collectively referred to as "gravel" is then pumped as a slurry down the workstring and through a "cross-over" into the annulus which is formed between the screen and the wall of the wellbore, e.g. well casing. The gravel is deposited in the annulus where it collects to form a permeable mass or pack around the screen which, in turn, allows the flow of fluids therethrough and into the screen while blocking the flow of any particulates.

Once a gravel-pack completion is installed, it normally remains in the well for so long as the production rate from the well is at a desired rate. When production drops below this rate, it may become necessary to remove the screen and its related workstring from the wellbore in order to "workover" the well. Removing the screen may be very difficult since the pack of gravel may be so compacted around the screen that it binds the screen within the wellbore and prevents the screen from being raised when an upward, pulling force is applied to the worksting.

In some instances, the upward force required to free and lift the screen will cause the screen, workstring, and/or connectors therein to fail before the screen is loose enough to be raised. When this happens, expensive "fishing" jobs and/or drilling operations are required to remove the screen and any workstring left in the wellbore. As will be recognized by those skilled in this art, this can be extremely time-consuming and very expensive and there can be no guarantee that such operations will be sucessful. Accordingly, there is a real need for a method whereby the gravel pack around a well screen can be loosened to allow the screen to be easily removed from the wellbore if, and when, such a need arises.

SUMMARY OF THE INVENTION

The present invention provides a method for removing a well screen from a wellbore of a well which has been "gravel packed". That is, the well has been completed by lowering the well screen into the wellbore where it is positioned adjacent a production formation. Gravel is then deposited to form a permeable mass in the annulus surrounding the screen to complete the gravel pack. Fluids produced from the formation will flow through the mass of gravel and into the screen while any particulate material produced with the fluids will be blocked by mass of gravel surrounding the screen.

When it is desired to remove the screen from the wellbore, a washstring is lowered down the wellbore and into the interior of said screen. A wash fluid is then pumped down the washstring and out through said screen into said mass of gravel to fluidize, loosen, and remove the gravel in the mass. Once the mass of gravel has been loosened, the screen is then lifted upward out of said wellbore.

In order to insure that the wash fluid will flow through the screen and into the mass of gravel and not up through the annulus formed between the washstring and the screen, the outer diameter of the washstring is sized so that it is only slightly smaller (about 10 sand grain diameters less) than the inside diameter of said screen. Also, the washstring may carry sealing means for further preventing any substantial upward flow of fluid between said washstring and said screen.

A nozzle is carried on the lower end of said washstring which has exit openings therein which are preferably inclined upward so that the wash fluid will exit in a substantially upward direction to enhance its agitating effect. A further sealing means may be provided on the nozzle below the exit opening for preventing any substantial downward flow through the screen.

BRIEF DESCRIPTION OF THE DRAWING

The actual construction, operation, and apparent advantages of the present invention will be better understood by referring to the drawing, not necessarily to scale, in which:

The FIGURE is an elevational view, partly in section, of the lower end of a cased wellbore wherein a "gravel-packed" screen is being removed in accordance with the present invention.

BEST KNOWN MODE FOR CARRYING OUT THE INVENTION

Referring more particularly to the drawing, the FIGURE illustrates the lower end of a producing and/or injection well 10. Well 10 has a wellbore 11 which extends from the surface (not shown) through a production and/or injection formation 12. Wellbore 11 is shown as being cased with casing 13 which, in turn, has perforations 14 therein to fluidly communicate the wellbore with formation 12, as will be well understood in the art. While well 10 is illustrated as being a substantially vertical, cased well, it should be recognized that the present invention is equally applicable for use in open and/or underreamed completions as well as in horizontal and/or inclined wellbores.

The production interval of wellbore 11 has been "gravel-packed" to control the production of particulates (e.g. sand) from formation 14. As will be fully understood in the art, a "gravel-pack" completion is one in which a screen 15 is lowered in wellbore 11 on a workstring (e.g. production tubing 16) and is positioned adjacent production formation 12. Properly-sized particulate material 17 (collectively called "gravel") is flowed in a slurry into annulus 18 which is formed between screen 15 and casing 13. Fluid from the gravel slurry is "lost" into formation 12 and/or screen 15 whereupon the gravel will accumulate in annulus 18 to form a fluid-permeable mass or "pack" of gravel around screen 15 which, in turn, allows the flow of fluid into screen 15 while blocking the flow of particulate material.

As illustrated, screen 15 is a typical well screen used in completions of this type. That is, screen 15 is comprised of a perforated base pipe 20 having a plurality of openings 21 therein. A continuous length of a wrap wire 22, which may be cut to provide a "keystone" cross-section, is coiled around base pipe 20 with each coil being slightly spaced from the adjacent coils to thereby form fluid passages (not shown) between the respective coils of wire. This type of screen is widely used and is commercially-available, e.g. BAKERWELD Gravel Pack Screens, Baker Sand Control, Houston, Tex. While this particular type screen has been illustrated, the present invention is equally applicable to other types of common well "screens" (e.g. all commercially-available screens, slotted or perforated liners or pipes, screened pipes, prepacked screens, and/or combinations thereof) so the use of the term "screen" herein is meant to cover and include any type of "screen" used in gravel-pack completions.

As will be understood in the art, gravel 17 will normally compact within the annulus 18 around screen 15 both during the installation of the gravel pack and during production of the well. Accordingly, when it becomes necessary to remove screen 15 from the wellbore for some reason, (e.g. workover the well to restore production), the mass of gravel 17 may have become so compacted that it binds the screen 15 within the wellbore to an extent where a normal pulling force on workstring 16 will not free the screen. Increased upward force on workstring 16 may result in failure or rupture of the workstring, screen 15, and/or connectors within the workstring. If this occurs, very time-consuming and expensive measures (e.g. "fishing" and/or drilling operations) are needed to clear the wellbore 11 before the well can be worked-over and production can be resumed.

In accordance with the present invention, a method is provided by which a gravel-packed screen can be readily removed from a wellbore. A washstring 25 is lowered down workstring 16 and into the interior of screen 15. The washstring 25 carries a nozzle 26 or the like on the lower end thereof which has a plurality of exit openings 27 therethrough (only a few shown). Preferably, openings 27 are inclined upwardly as shown so fluid will exit washstring 25 in an upward direction to enhance the ultimate agitating action of the wash fluid.

Washstring 25 and nozzle 26 are sized so that their respective outer diameters (OD) are only slightly smaller than the inside diameter (ID) of base pipe 20 (not to scale in the drawing for the sake of clarity). Preferably, the OD of wash sting-nozzle is approximately ten (10) sand grain diameters less than the ID of the base pipe. This extremely-close spacing between the wash string-nozzle and the base pipe will prevent any substantial upward flow of wash fluid between the washstring and the screen when the fluid exits the nozzle which, in turn, forces substantially all of the wash fluid out through screen 15 and into the mass of gravel 17. Also, sealing means 30 (e.g. packer, packer cups, etc.) can also be provided on washstring 25 to further prevent flow upward around the washstring. Similar sealing means 31 is positioned on the lower end of nozzle 26 below exit openings 27 to block any substantial downward flow through screen 15.

In operation, nozzle 26 is lowered on washstring 25 into screen 15. A wash fluid (e.g. gelled or ungelled) is flowed down the workstring and exits under pressure through openings 27 in nozzle 26. The fluid flows through openings 21 in base pipe 20 and out between the coils of wrap wire 22 into the mass of gravel 17. The wash fluid is pumped down washstring 25 at a pressure sufficient to generate an exit pressure great enough to agitate or fluidize the gravel and suspend the gravel therein to form a slurry therewith. As the slurry is formed, the mass of gravel is loosened (i.e. uncompacted) and circulated out of the wellbore so that screen 15 can be removed to the surface by merely pulling workstring 16 to the surface using only lifting forces within the strain limits of the workstring.

What is claimed is:

1. A method for removing a gravel-packed screen from a wellbore wherein said screen is surrounded by a pack of gravel, said method comprising:

lowering a washstring down the wellbore and into the interior of said screen, flowing fluid down said washstring and out through said screen into said pack of gravel to fluidize and loosen said pack of gravel; and lifting said screen upward out of said wellbore.

2. The method of claim 1 wherein said washstring has an outer diameter only slightly smaller than the inside diameter of said screen.

3. The method of claim 2 wherein said outside diameter of said washstring is about 10 sand grain diameters less than the inside diameter of said screen.

4. The method of claim 1 wherein said washstring includes a sealing means for preventing any substantial upward flow of fluid between said washstring and said screen and a sealing means for preventing any substantial downward fluid flow in said screen.

5. The method of claim 1 wherein said fluid exits said wash string through a nozzle carried on the lower end of said washstring.

6. The method of claim 5 wherein said nozzle has exit openings therein which incline upward.

7. A method for removing a well screen which is suspended in a wellbore on a workstring which extends to the surface wherein said screen is surrounded by mass of gravel, said method comprising:

lowering a washstring through said workstring and into the interior of said screen;

flowing a wash fluid down said washstring and out through said screen into said mass of gravel to fluidize and loosen said mass of gravel; and applying an upward force on said workstring to remove said screen.

8. The method of claim 7 wherein said washstring has an outer diameter only slightly smaller than the inside diameter of said screen.

9. The method of claim 8 wherein said outside diameter of said washstring is about 10 sand grain diameters less than the inside diameter of said screen.

10. The method of claim 7 wherein said washstring includes a sealing means for preventing any substantial upward flow of fluid between said washstring and said screen and a sealing means for preventing any substantial downward fluid flow in said screen.

11. The method of claim 7 wherein said fluid exits said wash string through a nozzle carried on the lower end of said washstring.

12. The method of claim 11 wherein said nozzle has exit openings therein which incline upward.

* * * * *